US006484890B1

(12) United States Patent
Miller

(10) Patent No.: US 6,484,890 B1
(45) Date of Patent: Nov. 26, 2002

(54) DUAL DISPLAY ASSEMBLY

(76) Inventor: Timothy James Miller, 229 Rainier Way, Fox Lake, IL (US) 60020

( * ) Notice: Subject to any disclaimer, the term of this patent is extended or adjusted under 35 U.S.C. 154(b) by 0 days.

(21) Appl. No.: 09/932,211

(22) Filed: Aug. 17, 2001

(51) Int. Cl.[7] ..... A47F 5/00

(52) U.S. Cl. ..... 211/45; 211/55; 211/128.1; 211/162

(58) Field of Search ..... 211/45, 46, 162, 211/94.01, 41.1, 94.5, 55, 128.1

(56) References Cited

U.S. PATENT DOCUMENTS

| | | | | |
|---|---|---|---|---|
| 1,835,744 | A | * | 12/1931 | Austin |
| 2,547,368 | A | * | 4/1951 | Booth |
| 3,185,309 | A | * | 5/1965 | Radek |
| 3,412,485 | A | * | 11/1968 | Reigler et al. |
| 3,534,863 | A | | 10/1970 | Howard |
| 3,965,583 | A | | 6/1976 | Price |
| 4,119,207 | A | * | 10/1978 | Fuller et al. ..... 211/45 |
| 4,331,245 | A | | 5/1982 | Schell |
| 4,446,974 | A | | 5/1984 | Ott |
| 4,604,061 | A | | 8/1986 | Willcocks et al. |
| 4,682,697 | A | | 7/1987 | Cohen |
| 4,757,906 | A | | 7/1988 | Ovitz, III |
| D303,460 | S | | 9/1989 | Schouten |
| D303,462 | S | * | 9/1989 | Schouten |
| 5,029,715 | A | * | 7/1991 | Strada ..... 211/55 |
| 5,031,781 | A | * | 7/1991 | Price et al. ..... 211/45 |
| 5,154,305 | A | * | 10/1992 | Whitney ..... 211/162 |
| 5,442,873 | A | | 8/1995 | Vogler |
| D368,181 | S | * | 3/1996 | Dabrowski |
| D372,816 | S | * | 8/1996 | Rose et al. |
| 6,170,674 | B1 | * | 1/2001 | Caterinacci ..... 211/55 X |

* cited by examiner

*Primary Examiner*—Robert W. Gibson, Jr.
(74) *Attorney, Agent, or Firm*—James P. Hanrath

(57) ABSTRACT

An integral dual display rack assembly includes a first frame member at front central position having a plurality of base-plate members attached thereto in a vertical column array to support a display of multiple first sample items of carpeting, flooring or the like. A second frame member, at least partially disposed rearward of the base-plate members and extending laterally from the plurality of base-plate members, includes a guide track assembly supporting a rollerable plurality of carriage frames suitable to support a second display item and to laterally move the same between a first storage position and a second display or viewing position. In such a fashion, a selected first display item upon the first frame member can be readily compared and contrasted with a selected second display item of the second frame member.

10 Claims, 6 Drawing Sheets

DUAL DISPLAY ASSEMBLY

BACKGROUND OF THE INVENTION

1. Field of the Invention

The present invention relates generally to retail display racks for display items, such as carpet and flooring samples, and more particularly to a integral dual display rack assembly providing a first frontal central display of multiple smaller sample pieces of display items conveniently contrasted with a second rearward and lateral display of selectable larger sample pieces of display items.

2. Description of the Related Art Including Information Disclosed Under 37 CFR §§ 1.97–1.99

Heretofore, various methods have been used to assist a customer in the selection of appropriate carpeting or flooring for residential, commercial, or other decor use.

For example, particularly with respect to carpeting, a variety of small rectangular carpet samples may be placed into a book binder designed to display numerous carpet patterns and variations of color which are available. Such samples are secured in the binder as by suitable post or bolt in a book-like arrangement which is usually standardized by providing carpet samples of given sizes to fit within the binder. In this matter, the customer can review a large selection of carpet patterns and colors and can even take selected samples out of the binder and home to determine how they might fit within a particular room and contrast against wall color, paneling, and other decor environments. A disadvantage of such binder-books resides in the fact that the perspective customer can only view one sample or a row of samples at a time rather than desirably viewing a number of samples simultaneously which provide a viewing of different color samples along with a given pattern sample. Hence, attempts have been made to provide carpet sample display racks to display a plurality of carpet samples. Such carpet display racks include a variety of mechanical structures including those disclosed in U.S. Pat. No. 3,534,863 to Howard, U.S. Pat. No. 3,965,583 to Price, U.S. Pat. No. 4,331,245 to Schell, U.S. Pat. No. 4,446,974 to Ott, U.S. Pat. No. 4,604,061 to Willcocks et al., and U.S. Pat. No. 4,682,697 to Cohen.

With respect to flooring samples, several types of display means have been traditionally used. For example, there is a display device in which samples are hung on rectangular frames which are swingable like hinged doors in a row or the pages of a book held upright. Another display devices is one where the samples are displayed on a stand in a cascading array so that it is necessary to lift one sample up to see another, even though the samples beneath the top one have exposed ends like a sloped deck of cards. In yet another arrangement for displaying floor covering samples, there is provided a display rack in which the samples are arranged one above the other in the rack like a row of books turned on their side, but it is still necessary for the customer to withdraw a sample for a complete view of the design, especially those at a higher level of the rack. Still further, as exemplified by U.S. Pat. No. 4,757,906 to Ovitz. III, proposed flooring samples may be folded in a U-shaped and inserted into a tower of divided stacked slotted compartments formed of heavy gauge wire.

The foregoing prior art points to a need for racks or display assemblies enabling consumers to conveniently select among numerous patterns, designs, and colors of displayed items of carpets, flooring samples, and the like.

SUMMARY OF THE INVENTION

According to the present invention there is provided an integral dual display assembly comprising a first frame member having a plurality of base-plate members attached thereto at a forwardly facing surface thereof, the base-plate members each having at least one flange border at a lower portion thereof, the base-plate members being suitable to hold a first display item on an upper facing surface thereof, and a second frame member at least partially disposed behind the plurality of base-plate members and extending laterally from the plurality of base-plate members, the second frame member including a guide track assembly, a plurality of carriage frames suitable to support a second display item, and means for laterally moving the plurality of carriage frames within the guide track assembly between a first storage position and a second display position. The first frame member can present numerous samples of carpet, flooring, or like at a forward or central position of the integral dual display assembly while the second frame member, rearward of the first frame member, presents numerous selectable larger samples of carpet, flooring or the like borne within carriage frames which are outwardly or inwardly laterally slidable upon caster rollers within cooperative track slots of a guide track assembly between a storage position and a display position. In such a fashion, a selected first display item upon the first frame member can be readily conveniently compared and contrasted with a larger second display sample of the second frame member.

In a preferred embodiment of the present invention, there is provided an optional third frame member set atop the guide track assembly of the second frame member which serves as a placard sign support and also defines a storage area rearward of the third frame member and above the second frame member. The integral dual display assembly of the present invention advantageously provides a singular viewing of numerous first display items of carpets, flooring samples, and the like at a forward central first frame member while allowing for the same to be compared and contrasted with larger second display items laterally shown by the second frame member. Particularly, the forward first frame member display section may be used for a consumer to select a color or pattern of the first display items found to be of initial interest. The consumer can then compare and contrast the first display item with a larger second display item of the second frame member display section to determine suitability of color and pattern selection, color and pattern coordination, pattern extent and layout, texture, grain, finish and other factors. The integral dual display assembly of the present invention provides flexibility and confidence in point of purchase decision-making when confronted with myriad choices of colors and patterns subject of carpeting, floor samples, or like items.

Additional features and advantages of the present invention will become apparent to those skilled in the art from the following description and the accompanying figures illustrating preferred embodiments of the invention, the same being the present best mode for carrying out the invention.

DESCRIPTION OF THE PREFERRED EMBODIMENT(S)

Figure 1:
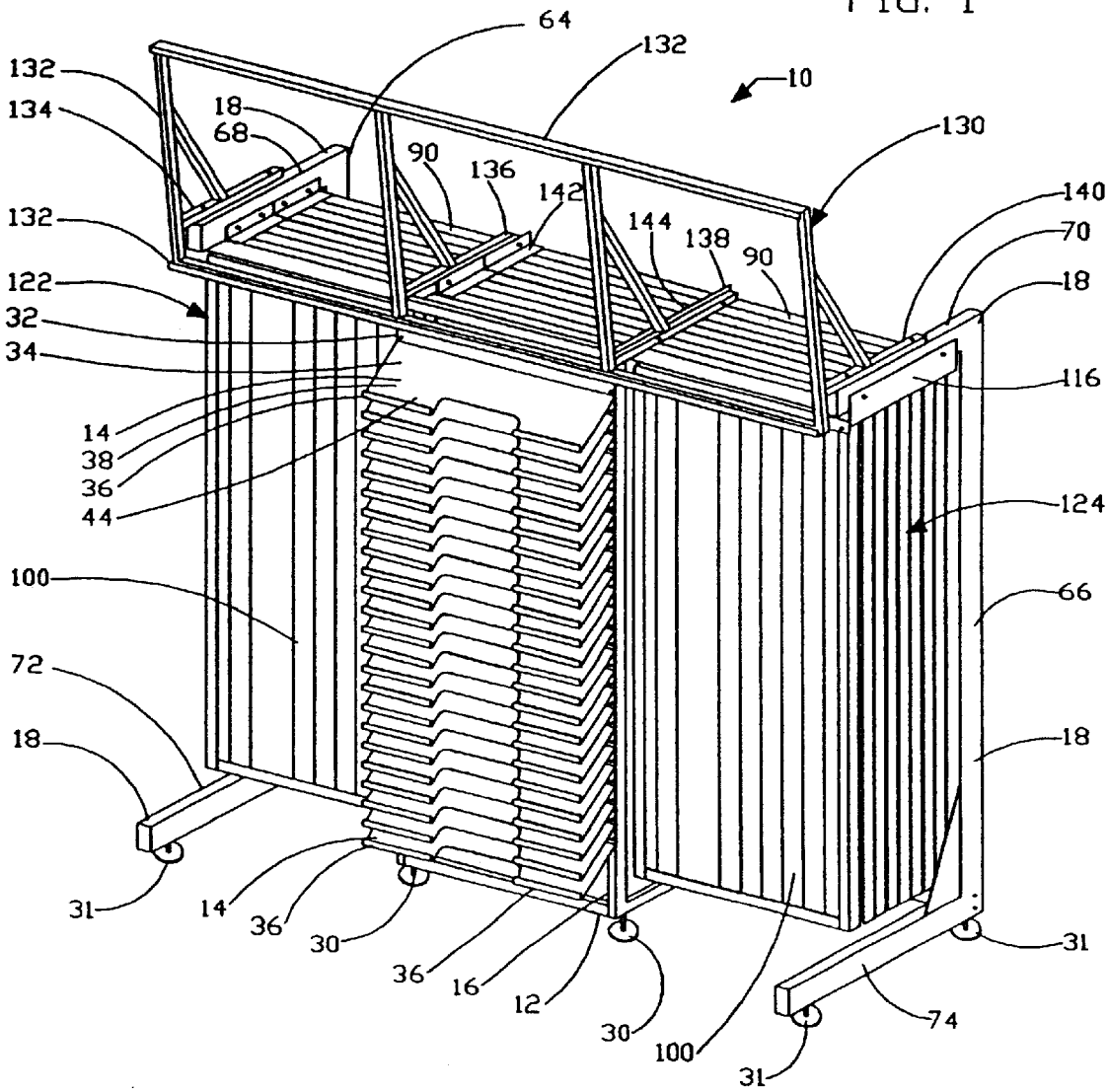
FIG. 1 is a front perspective view of a dual display assembly in accordance with my invention.

Referring now to FIG. 1 of the drawings there is shown a front perspective view of a dual display assembly in accordance with the teachings of the present invention. Dual display assembly 10 includes a first frame member 12 having a plurality of base-plate members 14 mounted thereon at a forwardly facing surface 16 of the first frame member 12 and a second frame member 18 at least partially rearward of and extending laterally of the base-plate members 14.

Figure 2:
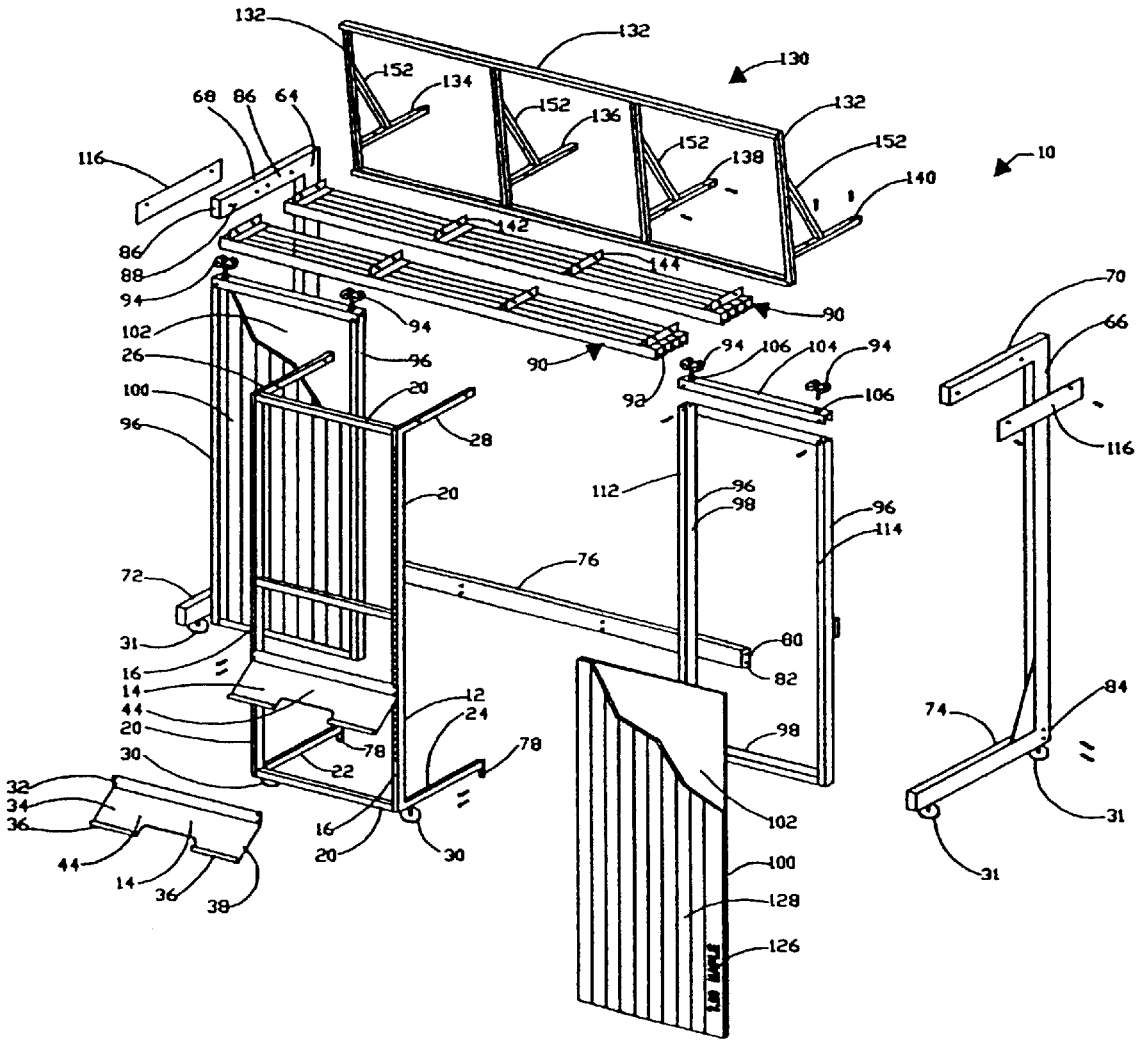
FIG. 2 is an front perspective view of the dual display assembly of FIG. 1 with the component parts thereof exploded.
Figure 3:
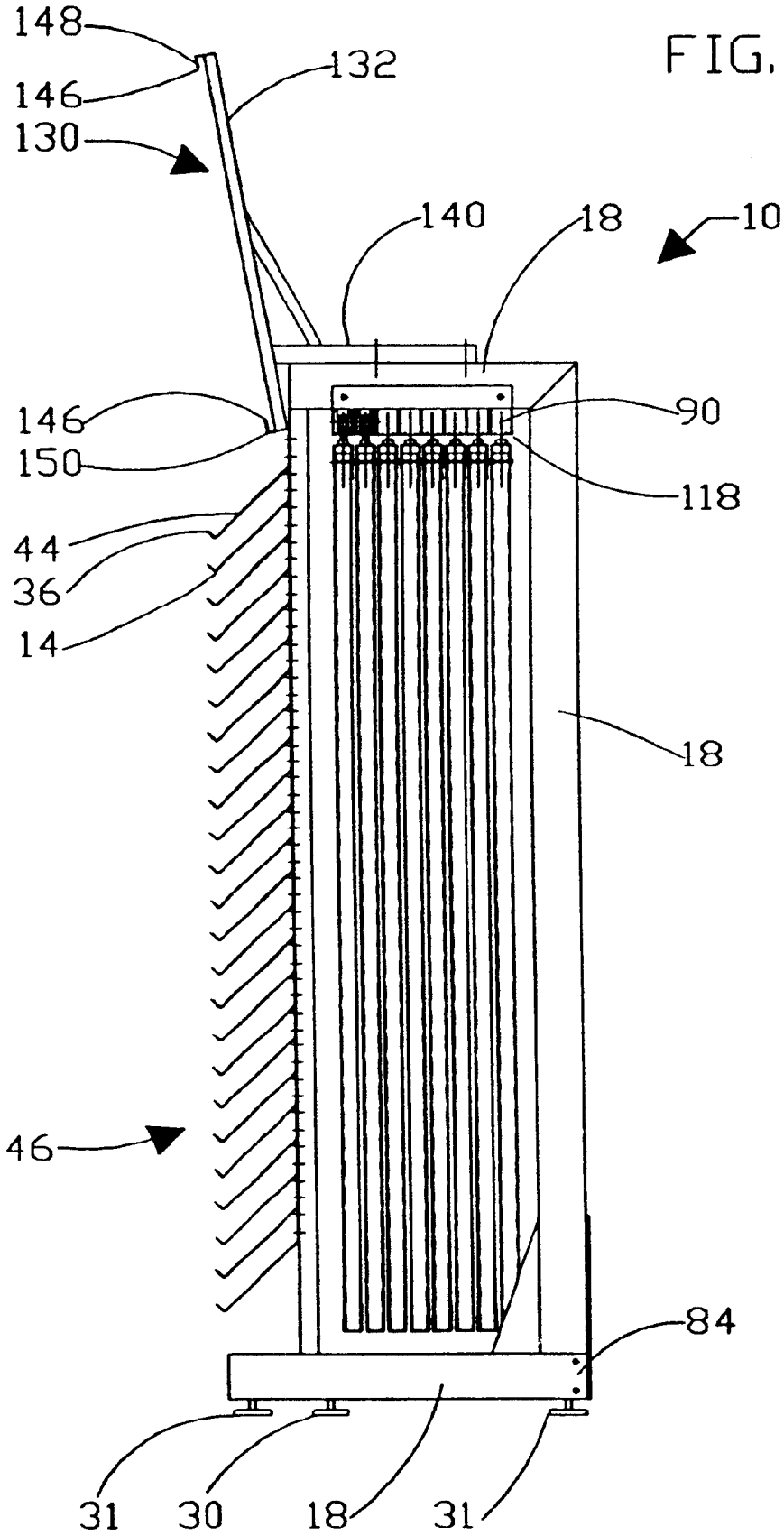
FIG. 3 is a side perspective view of the dual display assembly of FIG. 1.
Figure 5:
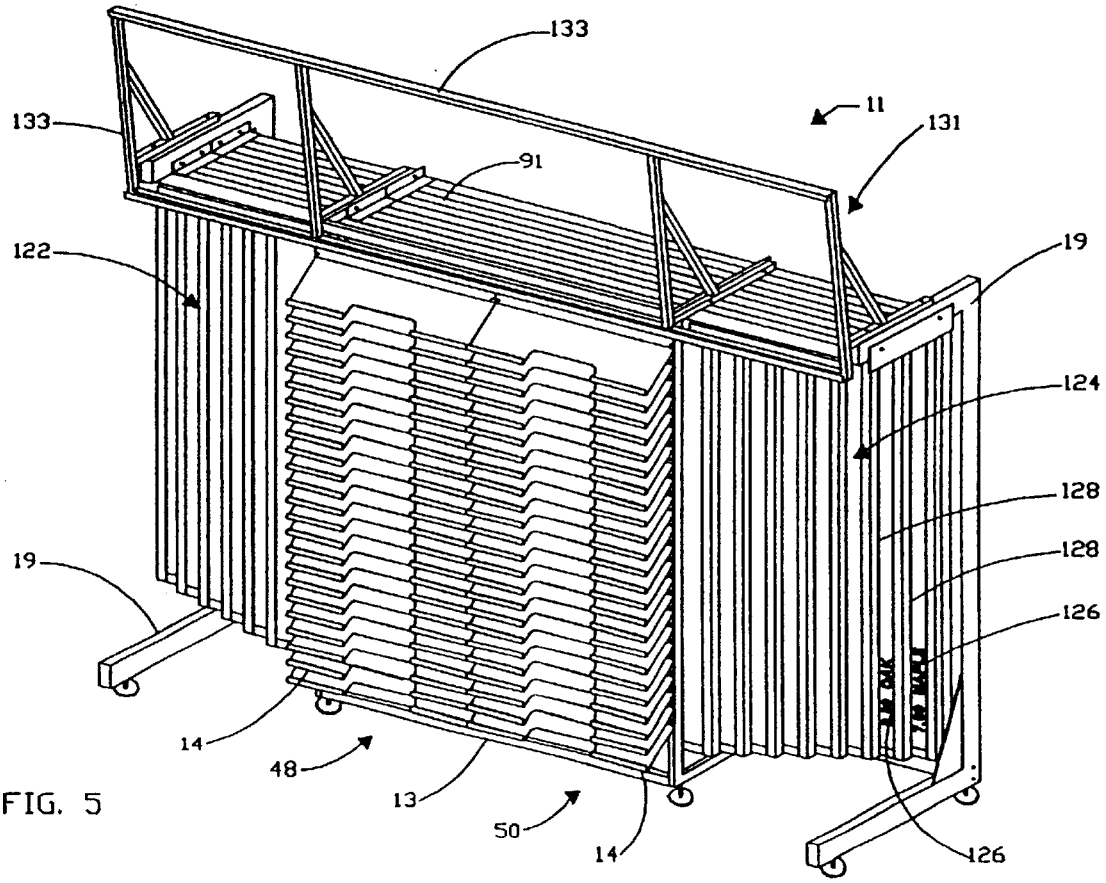
FIG. 5 is a front perspective view of a second embodiment of the dual display assembly in accordance with the present invention having two side-by-side first frame member frontal sample display assemblies and further illustrating the plurality of carriage frames of the second frame member being pulled outwardly on each side to a staggered position to simultaneously show multiple sample panels.
Figure 6:
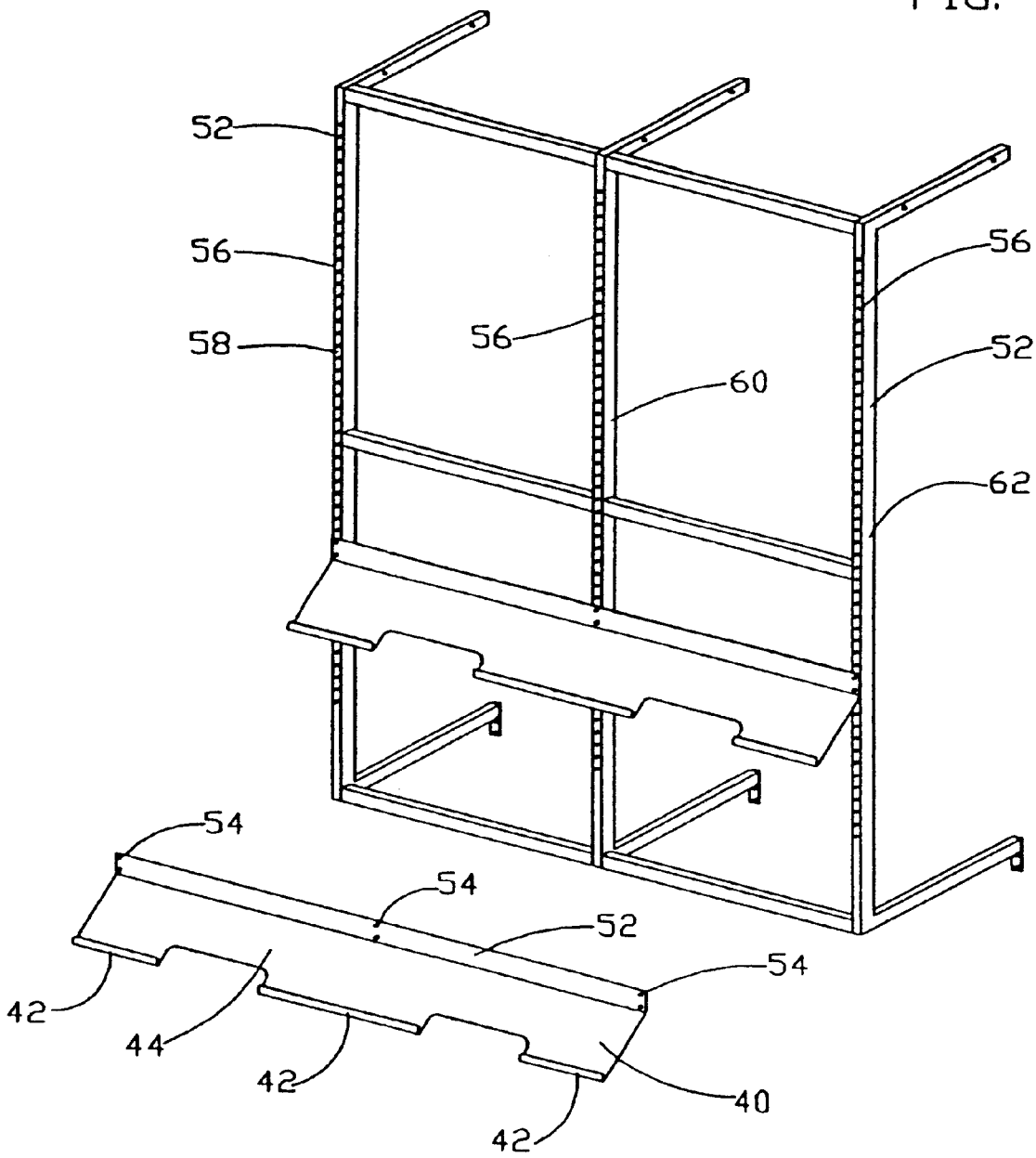
FIG. 6 is a front perspective view of an alternative base-plate member laterally exploded from its associated alternative first frame member.

As better observed in the exploded component view of FIG. 2, first frame member 12 comprises a rectangular base frame 20 with a pair of lower leg frames 22 and 24 and pair of upper leg frames 26 and 28 extending rearwardly therefrom. Lower leg frames 22 and 24 preferably include disc brace shoes 30 attached thereto by cooperative pin or bolt means. The rectangular base frame 20 has a forwardly facing surface 16 upon which may be attached a plurality of base-plate members 14. The base-plate member 14 may have a variety of designs, but will include a first upper portion 32 attachable to the forwardly facing surface 16 of first frame member 12, a second outwardly extending portion 34 which is preferably angled downwardly away from the first upper portion 32, and at least one flange border 36 at lower portion 38 of the second outwardly extending portion 34. For example, as illustrated at FIGS. 1 and 2, base-plate member 14 has two flange borders 36 at its lower portion while alternative base-plate member 40 illustrated at FIG. 6 having a greater length has three flange borders 42 at its lower portion. Each of the base-plate members 14 is suitable to hold a first display item, such as a sample of carpet, flooring, or the like, on an upwardly facing surface 44 thereof. The first upper portion 32 of each base-plate member 14 can be provided with a plurality of holes to correspondingly align and cooperate with an associated plurality of holes of the forwardly facing surface 16 of the first frame member 12 to accommodate nut and bolt joinder of each base-plate member to the first frame member. As best observed in the side perspective view of FIG. 3, the plurality of base-plate members 14 form a column row array 46 whereupon wide variety of first display items may be set upon the several respective upwardly facing surfaces 44 of the base-plate members 14 such that any individual first display item can be conveniently selected and removed therefrom by laterally displacing the same from a base-plate or lifting and removing the item over its flange border 36. The number of base-plates is arbitrary depending upon display needs and they are herein illustrated forming a composite set of 24 base-plates to accommodate a couple dozen of first display items. Further, the first frame member may be dimension to support a single column row array 46 of base-plate members 14, as observed in FIGS. 1 and 2, or may be dimension to support align adjacent multiple column row arrays 48 and 50 of base-plate members as observed in FIG. 5. As illustrated at FIG. 6, both the base-plate member 14 and the supporting first frame member 12 may be dimension in alternative embodiments. At FIG. 6, alternative base-plate member 40 is illustrated exploded from its associated alternative first frame member 52. Alternative base-plate member 40 has an upper portion 52 containing a pair of vertically align holes 54 near each of its respective lateral ends and at a middle section thereof for proper nut and bolt attachment to corresponding holes 56 of left vertical end post 58, of middle vertical post 60, and of right vertical end post 62 of the alternative first frame member 52.

Second frame member 18 is disposed at least partially behind the base-plate member 14 of first frame member 12 and extends laterally therefrom. Second frame member 18 is comprised of a pair of axially aligned vertical rear frames 64 and 66 respectively, having a pair of axially aligned upper leg frames 68 and 70 respectively, and a pair of axially aligned respectively extending outwardly and forwardly therefrom. Lower leg frames 72 and 74 of the second frame member 18 may include disc brace shoes 31 attached thereto by cooperative pin or bolt means.

Preferably, the second frame member 18 also includes a horizontal bottom base bar 76 which can serve as an anchor for lower legs frames 22 and 24 of the first frame member 12. In this regard, the lower legs frames 22 and 24 of the first frame member 12 each include a brace flange 78 at their rearward distal end. The brace flange 78 has at least one hole to correspondingly align and cooperate with an associated hole of the horizontal bottom base bar 76 of the second frame member 18 to accommodate nut and bolt joinder of the brace flange 78 to the horizontal bottom base bar 76. The horizontal bottom base bar 76 may be provided with a solid end face 80 containing tapped holes 82 at each of its lateral outwardly facing ends for bolt attachment with corresponding holes at a lower portion 84 of the pair of vertical rear frames 64 and 66 of the second frame member 18.

Figure 4:
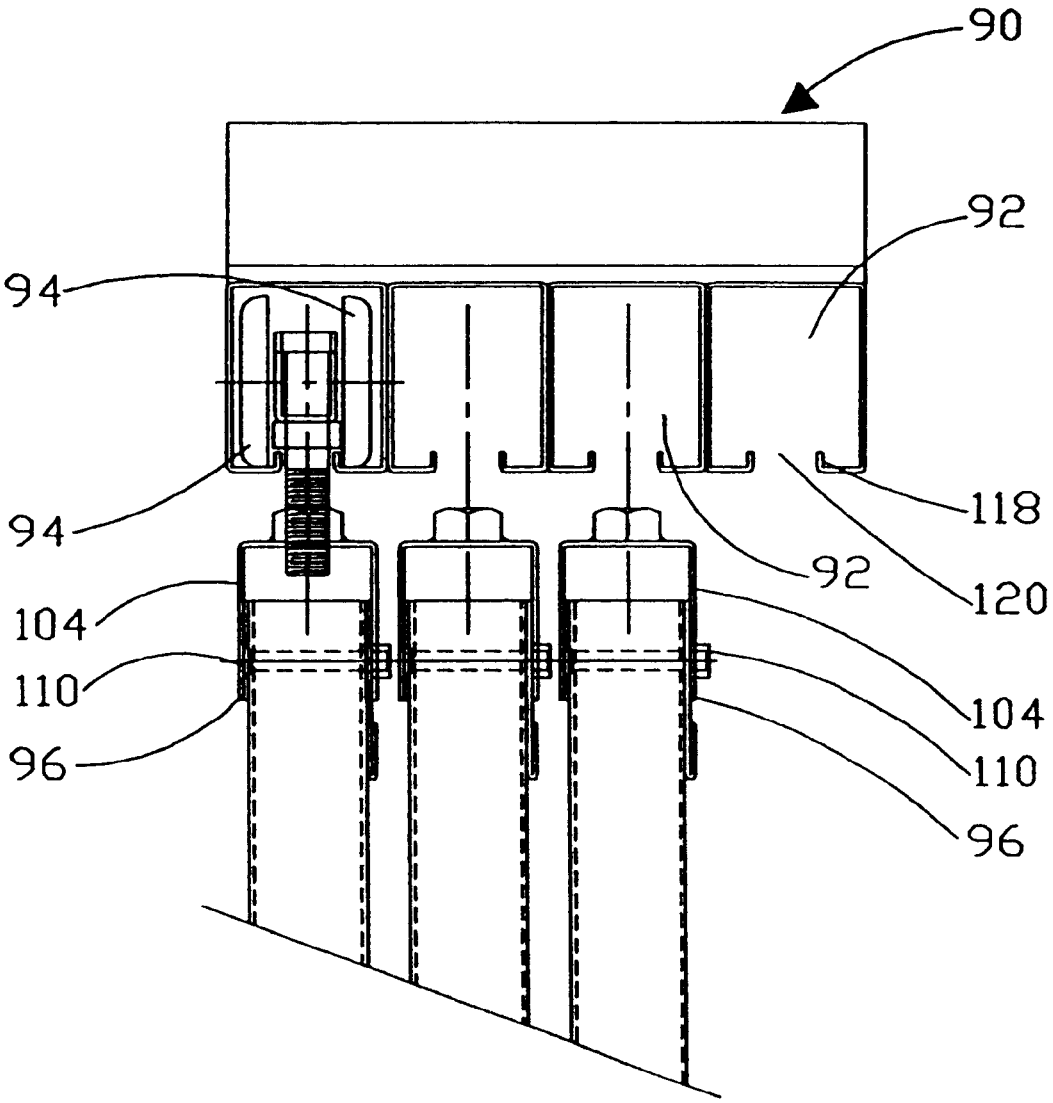
FIG. 4 is a side perspective view of the guide track assembly, the upper portion of the plurality of carriage frames, and means for moving the same within the guide track assembly.

Upper leg frames 68 and 70 of the second frame member 18 have a plurality of holes 86 at an inwardly facing surface 88 thereof suited to support nut and bolt attachment of a guide track assembly 90 therebetween. The guide track assembly 90, as best illustrated at FIG. 4, provides a plurality of guide channels 92 to receive and slidably support guide track roll wheels 94 of a plurality of carriage frames 96. Carriage frames 96, as best illustrated at the exploded view of FIG. 2, are rectangular shaped frames having support channels 98 at its entire inwardly facing periphery to receive and support a second display item, such as hardwood flooring panel 100, which may be optionally matted against a support board 102. In this regard, upper frame portion 104 of carriage frame 96 includes pair of threaded holes 106 and its upper facing surface near each lateral end border thereof which can receive a threaded stem 108 of guide track roll wheels 94 to thereby attach the guide track roll wheels 94 to the upper frame portion 104 of carriage frame 96. The upper frame portion 104 and its attached guide track roll wheels 94 may be removed from lock pin 110 attachment to side frame portions 112 and 114 of carriage frame 96 to allow axial insertion of a second display item within the support channels 98 of the carriage frame 96. After insertion of the second display item, upper frame portion 104 may be replaced upon and locked to side frame portions 112 and 114 by lock pins 110 inserted in aligned cooperative holes of the upper frame portion 104 and side frame portions 112 and 114 respectively. Each individual carriage frame 96 bearing a second display item may be slidably received into a guide channel 92 of the guide track assembly 90 for inward movement to a storage position or axially lateral outwardly movement to a display position. Once all carriage frames 96 are mounted in their respective guide channel 92 of guide track assembly 90, a closure piece 116 may be attached to enclose the open ends 118 of the guide channel pathway 120 of guide channels 92. Closure piece 116 has a pair of holes at an upper portion thereof cooperative for nut and bolt attachment of the same to aligned cooperative holes of the upper legs 68 and 70 of second frame member 18 whereupon a lower portion of the closure piece 116 encloses and forms an end border to the guide channel pathway 120 of the guide channels 92. Once assembled, mounted, and enclosed, the carriage frames 96 are laterally movable within guide track assembly 90 by means of the guide track roll wheels 94 between a inward storage position and an outward display position. Guide track assembly 90 is of a sufficient length to accommodate both a left group 122 of carriage frames and a right group 124 of carriage frames 96. The guide track assembly 90 illustrated at FIG. 4. has a width accommodating four guide channels 92, thus the pair of guide track assemblies illustrated at FIGS. 1, 2, and 5 provide eight guide channels to accommodate 16 carriage frames, namely a left group of 8 carriage frames and a right group of 8 carriage frames. Of course, the guide track assembly can be dimension to accommodate additional guide channels, the number of the same being arbitrary depending upon display needs.

Referring now to FIG. 5, there is illustrated a front perspective view of an alternative dual display assembly 11 in accordance with the teaching of the present invention. Alternative dual display assembly 11 is generally a larger dimensioned embodiment of a dual display assembly as compared to the dual display assembly 10 subject of FIGS. 1 through 4. By its larger dimension of first frame member 13 and second frame member 19, alternative dual display assembly 11 accommodates two side-by-side frontal sample display assemblies, namely the adjacently aligned multiple column row arrays 48 and 50 of base-plate members 14. FIG. 5 also further illustrating the plurality of carriage frames 96 of the second frame member 19 being pulled outwardly on each left and right ide thereof to a staggered position to simultaneously show multiple sample panels. In this regard, the inward storage position of each carriage frame 96 substantially stores the same behind the adjacently aligned multiple column row arrays 48 and 50 of base-plate members 14. Each carriage frame may be laterally moved via the guide track roll wheels 94 within each of their respective guide channels 92 of the guide track assembly 90 from this inward storage position to an outward display position. The outward display position of the carriage frames 96 may be partial or full. Indeed, the left group 122 and the right group 124 of carriage frames are illustrated as being arranged in a staggered presentation of the same from partially displayed to fully displayed when viewed front to back. This arrangement when combined with lettering or indicia 126 appearing at an outer side portion 128 of the second display item (such as price and model name appearing on the hardwood flooring panel 100 illustrated at the exploded view of FIG. 2) allows for the name identification of and commercial terms for differing colors, patterns, or models of multiple, or all, of the second display items to be simultaneously visually displayed in a convenient and contrasting manner for ready comparison to one another.

The present invention preferably includes an optional third frame member 130 which includes a frontal display frame 132 connected to at least one rearwardly extending leg frame. As illustrated at FIGS. 1 and 2, third frame member 130 has a frontal display frame 132 includes four rearwardly extending leg frames 134, 136, 138, and 140. The two outside rearwardly extending leg frames 134 and 140 are in each nut and bolt mounted atop upper leg frames 66 and 70 respectively of the second frame member 18 while the two inside rearwardly extending leg frames 136 and 138 are nut and bolt attached to the outer sides of brace plates 142 and 144 respectively set atop guide track assembly 90. Frontal display frame 132 is generally rectangular having a channel slot 146 formed by an upper retention flange 148 and a lower retention flange 150 which may support an advertising signage or placard inserted therein. Brace arms 152 may be employed to connect the four rearwardly extending leg frames 134, 136, 138, and 140 to the frontal display frame 132 for additional structural support.

In addition to providing an advertising signage or placard display set within channel slot 146, the frontal display frame 132 of the optional third frame member 130 also serves as a barrier to define a storage area to its rear above the guide track assembly 90. As illustrated at the larger dimensioned alternative dual display assembly 11 of FIG. 5, an optional alternative third frame member 131 has an its increased length of the alternative frontal display frame 133 which likewise serves as a barrier to define a storage area to its rear above the increased length of alternative guide track assembly 91.

With the exceptions of the guide track roll wheels 94 operative in the guide channel pathway 120 of guide channels 92 (which are preferably of a durable plastic), the various structural component parts of the dual display assembly of the present invention may be fabricated from stainless-steel by methods known in such fabrication arts.

From the foregoing description, it will be apparent that the dual display assembly of the present invention has a number of advantages, some of which have been described above and others of which are inherent in the invention. Also it will be understood that modifications can be made to the dual display assembly described above, particularly to dimension and capacity of the functional structural component parts thereof, without departing from the teachings of the present invention. Accordingly, the scope of the invention is only to be limited as necessitated by the accompanying claims.

I claim:

1. A dual display assembly comprising:

a first frame member having a plurality of base-plate members attached thereto at a forwardly facing surface thereof, said base-plate members each having at least one flange border at a lower portion thereof, said base-plate members being suitable to hold a first display item on an upper facing surface thereof, and a second frame member at least partially disposed behind said plurality of base-plate members and extending laterally from said plurality of base-plate members, said second frame member having a left-hand portion, a center portion, and a right-hand portion, said second frame member including a guide track assembly, a plurality of carriage frames suitable to support a second display item, and means for laterally moving said plurality of carriage frames within said guide track assembly between a first storage position and a second display position, said first frame member being disposed at said center portion of said second frame member.

2. A dual display assembly according to claim 1 further including a third frame member having at least one rearwardly extending leg set upon said second frame member or said guide track assembly and a frontal display frame having a channel slot suitable to receive and support a placard set therein.

3. A dual display assembly according to claim 2 wherein said third frame member defines a storage area above said guide track assembly.

4. A dual display assembly according to claim 1 wherein said base-plate members have a first upper portion attached to said first frame member and a second downwardly extending portion angled away from said first upper portion.

5. A dual display assembly according to claim 4 wherein said first frame member includes a forwardly facing surface having a plurality of holes and said base-plate members include a first upper portion having a corresponding plurality of cooperative holes so that the base-plate members are attached to said first frame member by cooperative nut and bolt.

6. A dual display assembly according to claim 1 wherein said first frame member comprises a rectangular base frame, a pair of bottom leg frames extending rearward of said rectangular base frame in spaced axial alignment to each other, and a pair of upper leg frames extending rearward of said rectangular base frame in spaced axial alignment to each other, said bottom leg frames and said upper leg frames defining at least a partial storage area for said plurality of carriage frames.

7. A dual display assembly according to claim 6 wherein said upper leg frames of said first frame member are set upon an upper surface of said track guide assembly of said second frame member.

8. A dual display assembly according to claim 6 wherein said bottom leg frames of said first frame member are attached to a horizontal base bar of said second frame member.

9. A dual display assembly according to claim 1 wherein said said second frame member comprises a pair of vertical frames, each vertical frame having an upper leg frame and a lower leg frame extending forwardly thereof, said vertical frames, upper leg frames, and lower leg frames being disposed in spaced axially aligned cooperative relation to each other, and said guide track assembly is attached to said upper leg frames.

10. A dual display assembly according to claim 1 wherein said means for laterally moving said plurality of carriage frames within said guide track assembly between a first storage position and a second display position comprise a guide track roll wheel being attached to each of said plurality of carriage frames to be supported by cooperative corresponding guide channels of the guide track assembly.

* * * * *